US007140121B2

(12) United States Patent
Casella et al.

(10) Patent No.: US 7,140,121 B2
(45) Date of Patent: Nov. 28, 2006

(54) GARMENT DRYING CABINET AND SYSTEM

(76) Inventors: Anthony Casella, 79 Woody La., Cushing, ME (US) 04563; Lawrence Butz, 2420 N. Pine Creek Rd., La Crescent, MN (US) 55947-9619; Robert Cox, W 280 Sunshine Dr., Stoddard, WI (US) 54658; Theodore E Tinsler, 15443 kirkwood Rd., Sidney, OH (US) 45365

( * ) Notice: Subject to any disclaimer, the term of this patent is extended or adjusted under 35 U.S.C. 154(b) by 0 days.

(21) Appl. No.: 11/024,222

(22) Filed: Dec. 27, 2004

(65) Prior Publication Data

US 2006/0137211 A1 Jun. 29, 2006

(51) Int. Cl.
*F26B 25/06* (2006.01)

(52) U.S. Cl. ..... 34/201; 34/202; 34/231; 34/96

(58) Field of Classification Search ..... 34/96, 34/97, 201, 202, 231
See application file for complete search history.

(56) References Cited

U.S. PATENT DOCUMENTS

| | | | | |
|---|---|---|---|---|
| 4,682,424 | A * | 7/1987 | Irving | 34/621 |
| 5,555,640 | A * | 9/1996 | Ou | 34/202 |
| 5,815,961 | A * | 10/1998 | Estes et al. | 38/14 |
| 5,829,162 | A * | 11/1998 | Pace | 34/202 |
| 6,035,545 | A * | 3/2000 | Jones | 34/202 |
| 6,745,496 | B1 * | 6/2004 | Cassella | 34/621 |

* cited by examiner

*Primary Examiner*—Kenneth Rinehart
(74) *Attorney, Agent, or Firm*—Michael J. Persson; Lawson & Persson, P.C.

(57) ABSTRACT

A garment drying cabinet and a garment dryer utilizing the garment drying cabinet. The garment drying cabinet includes a housing through which at least one heater mounting opening and at least one exhaust hole are disposed. At least one heater mount is attached to the housing proximate to each mounting opening and is dimensioned to attach a heater to the housing such that the air directed from the heater is delivered into the interior of the housing. A cabinet door is movably attached to the housing. The garment dryer combines the drying cabinet with at least one heater.

17 Claims, 5 Drawing Sheets

GARMENT DRYING CABINET AND SYSTEM

FIELD OF THE INVENTION

The present invention relates to the field of drying devices and, in particular, to a garment drying cabinet and system for drying and de-wrinkling articles of clothing utilizing such a cabinet.

BACKGROUND OF THE INVENTION

The present invention represents the culmination of many years of development, which began in response to a need that surfaced in one of the co-inventor's automobile and truck restoration businesses. At the time, he had seven shops and eighty-six employees. An accountant brought the business' exorbitant cleaning expenses to the attention of the co-inventor, who was always looking for creative ways to ensure quality and control costs. Full-time mechanics needed sharp-looking uniforms to be cleaned quickly and without ironing in machines that could be operated by unskilled, part-time employees.

Despite this need, conventional cleaning and drying equipment failed to provide an effective solution. For example, conventional dry cleaning equipment is large, expensive, requires the use of harmful chemicals, and requires trained operators in order to effect satisfactory results. Because of these factors, such equipment is not readily available or desirable to individuals or small businesses.

Conventional wet washing and tumble-drying machines are effective at cleaning and drying clothing, and are readily available, and affordable, to individuals and small businesses. However, conventional tumble-drying typically results in dried clothes that are wrinkled and, therefore, not suitable for wear without de-wrinkling via ironing, steaming, or other art recognized means.

A number of non-tumble type dryers have been developed and patented. However, each of these fails to solve the problems encountered by the inventor of the present invention. For example, U.S. Pat. No. 5,555,640, titled "Household Drying Center", discloses a multipurpose household drying center in which a blower and heating chamber are disposed on the top portion of a cabinet to generate forced and heated air downward into a drying chamber in the cabinet below the heating chamber. There are horizontally disposed heat diffusion plates under the heating chamber and vertically disposed air ducts on the side walls of the cabinet to enable heated air to be evenly distributed and filled in the drying chamber for uniform drying of the goods held therein. A support stand having a horizontal and rectangular frame secured on the top ends of a pair of spaced and vertical telescopically structured tubes is disposed within the drying chamber for hanging clothes, and can support a wire basket for holding delicate or odd shape goods for drying. There are side rods on the sidewalls for hanging articles, and a base grid is provided above the bottom wall to hold heavy or odd shape goods for drying.

The above referenced patent states "clothes and goods are dried without tumbling, thus avoiding fraying or wrinkles." However, this is not the case as the drying center fails to monitor and adjust the air for temperature and humidity, which are the primary factors in reducing wrinkles. Further, it requires that that same hot air be utilized for drying, creating a risk of damage to the clothing being dried and the risk of bums to users. Accordingly, although a distinct improvement over conventional tumble dryers, this drying center does not produce the level of sharp, wrinkle free clothing required to meet the needs of the inventor nor does it provide any safeguards against damage to clothing or injury.

U.S. Pat. No. 4,682,424, titled "Clothes Drying Apparatus", describes yet another non-tumble style drying apparatus that includes a hanger rod mounted above a drip pan element, that may be slidably removed from a drying cabinet so that wet clothing articles may be easily mounted on the hanger rod. The patent discloses a system that is similar to that disclosed in U.S. Pat. No. 5,555,640, and further includes an automatic control so that the drying cycle may be pre-selected so as to achieve the most efficient drying of the clothing articles. However, this apparatus also has distinct drawbacks that make it unsuited to satisfactorily solving the problems solved by the present invention. For example, like the dryer of U.S. Pat. No. 5,555,640, this apparatus fails to monitor and adjust the air for temperature and humidity, which are the primary factors in reducing wrinkles. Further, it likewise requires that that same hot air be utilized for drying, creating a risk of damage to the clothing being dried and the risk of bums to users.

Another non-tumble dryer is disclosed in U.S. Pat. No. 5,815,961, titled "Clothes Treating Cabinet with Inflatable Hanger". This patent discloses a clothes treating apparatus having a cabinet that defines an interior region for receiving clothes. The interior region has opposed inner side surfaces and a door is connected to the cabinet for closing the interior region. An inflatable hanger for supporting shirt-like clothes items is disposed within the interior region and is in communication with a blower that selectively inflates the inflatable hanger for pressing the shirt-like clothes item against the cabinet inner side surfaces. A steam generation means is provided for introducing moist air into the cabinet for humidifying the clothes item disposed therein. A heater and fan supply heated air into the interior region for drying the shirt-like clothes items disposed therein. During the de-wrinkling cycle, steam is introduced into the interior region while the inflatable hanger assembly is periodically inflated. Following the steaming period, the inflatable hanger is inflated while the clothes are subject to warm air such that the clothes wrinkles are pressed out and the clothes are partially dried, setting the clothes in a smooth appearance. Heated air is then delivered into the interior region to completely dry the clothes item.

This system claims to be effective at de-wrinkling already dried clothes, but has inherent drawbacks. The first, and foremost, of these drawbacks is the need to carefully arrange the clothing and inflatable hanger to avoid any unwanted creasing of the garment. If the hanger and clothing are not properly arranged, the inflation of the hanger will cause the garment to fold upon itself and cause a crease or wrinkle in an unwanted area. Another drawback is that the inflation of the hanger is unsuited for garments, such as pants or skirts, that require creases to be formed in the material. Another drawback is the increased cost involved in manufacturing an inflatable hanger and the need for hangers of many sizes to accommodate the many sizes of garments. Finally, the need to generate a separate flow of steam over the garment is undesirable due to the safety hazard attendant to live steam, the need to pipe in a source of water, or continually refill a water reservoir, and the increased cost in providing means for heating and distributing the steam. Accordingly, the system described in U.S. Pat. No. 5,815,961 is not effective at solving the problem of the present invention.

In response to these drawbacks, the co-inventor developed the air-flow dryer and method described and claimed in U.S. Pat. No. 6,745,496, which is incorporated herein by reference and referred to herein as "Air Flow I". The dryer of this patent is effective at overcoming the drawbacks inherent in prior art dryers. However, the fixed nature of this product, and the need for portable drying units for travel purposes, led to the development the portable drying apparatus disclosed and claimed in co-pending U.S. patent application Ser. No. 10/935,416, which is likewise incorporated by reference and is referred to herein as "Air Flow II".

The Air Flow II apparatus was originally designed for transport during travel. However, the development of the apparatus into a commercial product also revealed that the Air Flow II apparatus could replace the mechanical assembly located within the upper compartment of the Air Flow I apparatus to provide a lower cost alternative thereto. In these embodiments, the Air Flow II apparatus was mounted within the Air Flow I cabinet such that they were oriented downward to produce the same "top down" drying action that the co-inventor believed to be critical to the dewrinkling of the clothing. However, although effective at drying garments, it did not meet the drying time goals set by the co-inventor.

Therefore, the inventor sought to develop an improved drying apparatus that allows garments to be dried quickly and without ironing or use of another appliance, that may be operated by unskilled, part-time employees, that does not require a large initial investment, a large space or the use of hazardous chemicals or live steam, that effectively removes wrinkles while drying, that does not risk the creation of additional wrinkles, that may be mounted anywhere within a home, and that does not require piping or constant filling of a water reservoir, and that utilizes low cost fan heaters to produce a flow of heated air over the garments without significantly increasing drying times over those obtained using the Air Flow I apparatus.

SUMMARY OF THE INVENTION

In order to further improve his dryer, the co-inventor sought the assistance of the other co-inventors, who performed numerous tests and made a number of modifications to the dryer. This testing confirmed the that the dryer disclosed and claimed herein, hereafter referred to as Air Flow III, produced the fastest drying times while maintaining the wrinkle free properties of the Air Flow I and Air Flow II units. However, the Air Flow III unit did not utilize the "top down" drying action that the co-inventor believed to be so critical to the dewrinkling properties of the Air Flow I and II, but rather used a unique baffle type arrangement to blow air over the garments from a variety of directions rather than just from the top down. Further, although a variety of different cylinder type fan heaters were identified as being usable, the fan heaters utilized during testing were conventional hair dryers. This led the original co-inventor to conceive of a low cost garment drying cabinet that could be sold without fan heater units, but rather would include attachments to allow conventional hair dryers to be attached to the garment housing to produce the necessary flow of heated air.

Therefore, the present invention is a garment drying cabinet and a garment dryer utilizing the garment drying cabinet. In its most basic form, the garment drying cabinet includes a housing comprising a back wall, a right side wall, a left side wall, a top wall and a bottom wall defining an interior and an exterior of the housing. At least one heater mounting opening is disposed through the housing, and at least one exhaust hole is disposed through at least one of the bottom wall, the right side wall, and the left side wall of the housing. At least one heater mount is attached to the housing. The heater mount is dimensioned to attach the source of heated air to the exterior of the housing such that substantially all of the air directed from the source of heated air is delivered into the interior of the housing. At least one air diverter mounted in the path of the heated air and is dimensioned to direct air upon the garment from at least two directions. Finally, a cabinet door is movably attached to the housing.

In preferred embodiments of the garment drying cabinet, the air diverter is at least one baffle attached to the interior of the housing a predetermined distance from the right side wall, the left side wall, and the top wall of the housing so as to define at least one air duct and at least one drying compartment. The preferred baffles include at least one air opening disposed therethrough such that the air ducts are in fluid communication with the at least one drying compartment. The air ducts are preferably sealed such that a substantial portion of the heated air delivered into the interior of the housing from the source of heated air will flow through the air openings into the drying compartment.

The preferred embodiment includes a right baffle and a left baffle that attach to the back wall and the right wall and the left wall respectively and form a top air opening. Each of the baffles preferably includes at least one, and ideally two, air openings and the top air opening, the right air opening and the left air opening are each preferably disposed within the housing and dimensioned such that no more than thirty percent of the air directed from the source of heated air into the interior of the housing passes through the top air opening. The air ducts formed by the baffles are preferably narrow and, therefore, it is preferred that a substantial portion of the right an left baffles be disposed a distance of between 0.5 inches and 2.5 inches from, and in substantially parallel relation to, the right and left side walls, respectively.

In some embodiments, the air openings through the baffles are merely holes that allow heated air to flow perpendularly from the baffle. However, it is preferred that that air openings include air deflectors that are dimensioned to deflect the heated air both inward towards the drying compartment and upward toward the top wall of the housing.

The preferred garment drying cabinet also includes a right angled wall attached to the back wall, the top wall and the right wall, and a left angled wall attached to the back wall, the top wall and the left wall. In such embodiments, a left heater mount is preferably disposed upon the left angled wall and the right heater mount is preferably disposed upon the right angled wall such that heated air is directed in angular relation into the interior of the cabinet. In its most basic form, the garment dryer of the present invention includes the garment drying cabinet of the present invention and at least one heater attached to the each heater mount. The preferred embodiment includes a left and right heater mount to which left and right heaters are attached. The preferred heaters each have a diameter of between 1.5 inches and 3.5 inches and each preferably produces a volume of airflow of between 40 and 70 cubic feet per minute. In the preferred embodiment, the heaters and the cabinet are dimensioned and adapted to maintain a temperature of at least 130 degrees Fahrenheit within the interior of the housing.

In some embodiments, the air diverters are deflectors mounted within the path of the incoming heated air from the heater. The preferred diverters are disposed so as to direct approximately ten percent of the heated air over the center of the garment and to allow the remaining ninety percent of the air to flow over the periphery of the garment. In some preferred embodiments, the diverter is approximately six and three eights inches long and includes a straight portion of approximately three and one half inches and a curved portion that terminates at an approximately forty five degree angle from a line extending perpendicular to the straight portion. The preferred deflector terminates approximately two inches from the top of the garment so as to create significant turbulence when the heated air comes into contact therewith.

Therefore, it is an aspect of the invention to provide a garment dryer that allows garments to be dried quickly and without ironing or use of another appliance.

It is a further aspect of the invention to provide a garment dryer that may be operated by unskilled, part-time employees.

It is a further aspect of the invention to provide a garment dryer that does not require a large initial investment.

It is a further aspect of the invention to provide a garment dryer that does not require a large space or the use of hazardous chemicals or live steam.

It is a further aspect of the invention to provide a garment dryer that effectively removes wrinkles while drying and that does not risk the creation of additional wrinkles.

It is a further aspect of the invention to provide a garment dryer that may be mounted anywhere within a home and that does not require piping or constant filling of a water reservoir.

It is a further aspect of the invention to provide a garment dryer and that utilizes low cost fan heaters to produce a flow of heated air over the garments without significantly increasing drying times over those obtained using the Air Flow I apparatus.

It is a further aspect of the invention to provide a garment dryer and that utilizes a garment drying cabinet to which conventional hair dryers may be attached to produce the desired drying action.

It is a still further aspect of the invention to provide a drying apparatus that may be safely used around children.

These aspects of the invention are not meant to be exclusive and other features, aspects, and advantages of the present invention will be readily apparent to those of ordinary skill in the art when read in conjunction with the following description, appended claims and accompanying drawings.

DETAILED DESCRIPTION OF THE INVENTION

Figure 1:
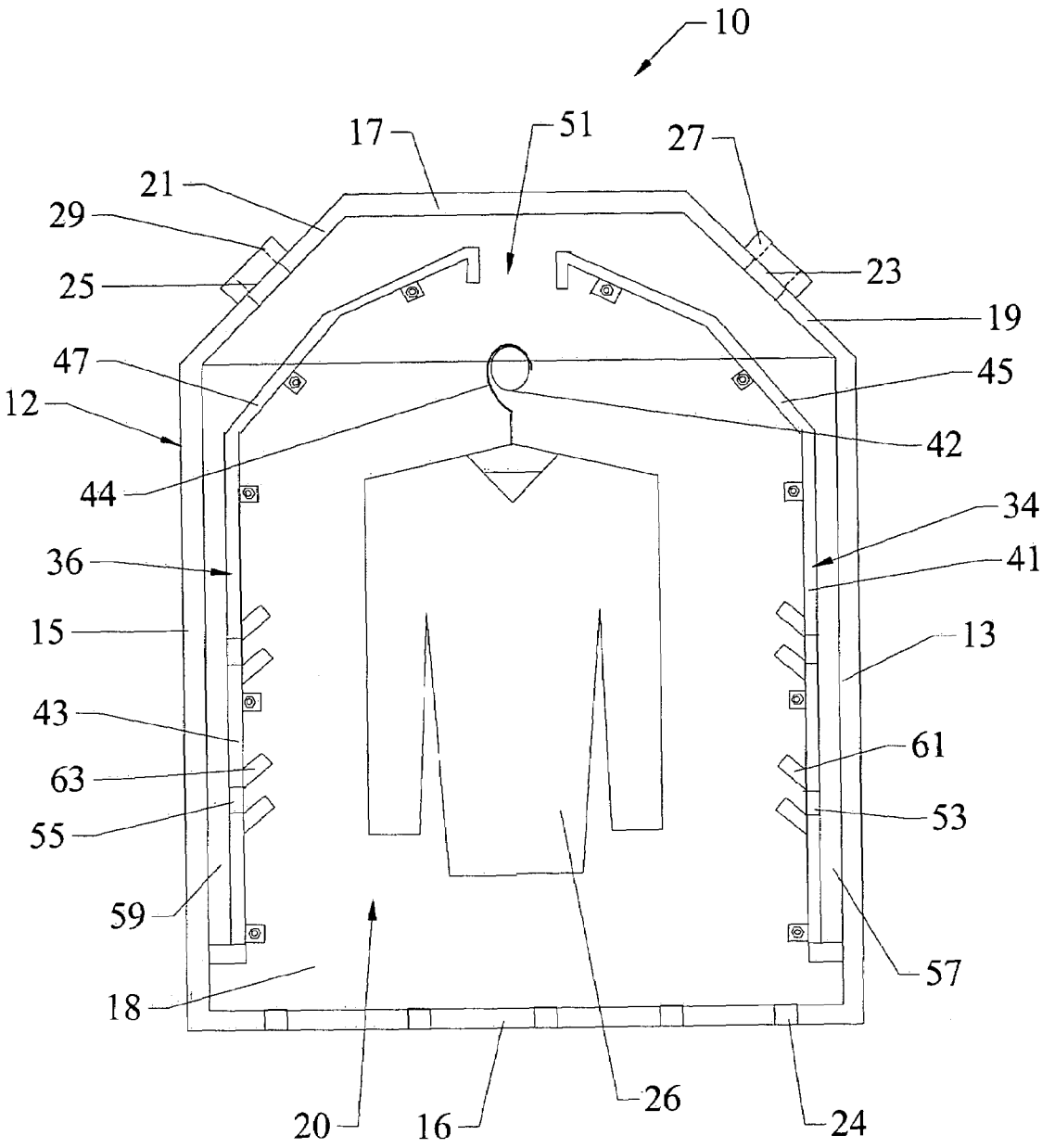
FIG. 1 is a cut away diagrammatic view of the front of the preferred garment drying cabinet of the present invention with a portion of the walls removed to show the baffles, air ducts and heater openings.

Referring first to FIG. 1, the preferred garment drying cabinet 10 of the present invention includes a housing 12 that presents as a tall box of relatively shallow depth having a back wall 18, a right side wall 13, a left side wall 15, a top wall 17, a bottom wall 16, and a substantially open front. Preferred housing 12 has a height of approximately five feet, a width of approximately three feet and a depth of approximately one foot. In the preferred embodiment of FIG. 1, the top wall 17 is joined to the right and left side walls 13, 15 via left and right angled walls 19, 21. However, in other embodiments, the angled walls 19, 21 are eliminated and the right and left side walls 13, 15 are attached in substantially perpendicular relation to the top wall 17. The housing 12 may be constructed of a wide variety of materials including wood, plastic and sheet metal. The preferred housing is manufactured of wood to provide a finished, "furniture-like", look to the drying cabinet 10.

In the embodiment of FIG. 1, a plurality of exhaust holes 24 are disposed through the bottom wall 16 of the housing 12 to allow heated air to be exhausted from the drying compartment 20. The preferred bottom wall 16 has a total of fifteen exhaust holes 24, which are preferably evenly spaced and have a diameter of one inch. This arrangement is preferred when the preferred heaters (not shown) are mounted in the heater mounts 27, 29, as the combination of these heaters and the exhaust holes 24 allows the heaters to produces a volume of airflow of between 40 and 70 cubic feet per minute while maintaining a temperature of at least 130 degrees Fahrenheit within the interior of the housing 12. However, other embodiments may use greater or lesser numbers of exhaust holes 24, and/or exhaust holes of different diameters, to achieve similar results. Further, although the exhaust holes 24 are preferably disposed through the bottom wall 16, in embodiments of the cabinet 10 that do not include baffles 34, 36, such as the embodiment shown in FIG. 3, exhaust holes 24 may be disposed through the bottom wall 16, left side wall 15 and/or right side wall 13. Regardless of where the exhaust holes 24 are disposed, because of the need to expel air through the exhaust holes 24, the housing 12 must be mounted such that air may escape therethrough. This is preferably accomplished by leaving a space between the housing and an interior floor or wall of the room in which it is disposed to allow the air to mingle with the interior of the room. However, it is recognized that the exhaust holes 24 may be in communication with a conventional exterior duct (not shown), which directs the exhaust air to the building exterior.

Heater openings 23, 25 are disposed through the housing 12 and heater mounts 27, 29 are attached to the exterior of the housing 12 proximate to the heater openings 23, 25. In the preferred embodiment, the heater openings 23, 25 are disposed through the angled walls 19, 21, which allow the heated air blown by the heaters (shown in FIG. 2) to be more easily diverted to desired locations within the drying compartment. However, the heater openings 23, 25 may be disposed through the top wall 17 or, in embodiments in which baffles or diverters are utilized, through the side walls 13, 15, to achieve similar results.

Heater mounts 27, 29 may take a many forms, provided they are capable of attaching the sources of heated air to the exterior of the housing 12 such that substantially all of the air directed from the sources of heated air is delivered into the interior of the housing. In testing performed by the co-inventors, common household hair dryers served as the source of heated air, and it is envisioned that such dryers will serve as the source of heated air in many embodiments of the garment dryer. As the diameter of the air outlet, through which heated air is directed, will vary from hair dryer to hair dryer, it is preferred that the heater mounts 27, 29 be designed to accommodate air outlets of varying diameters. In the preferred embodiment, the heater mounts 27, 29 include flexible rubber sleeves and hose clamps, which attach to the air outlets of the hair dryers, or other sources of heated air, in a manner similar to that utilized by plumbers when attaching a PVC drain pipe to an existing cast iron waste line. In other embodiments, the heater mounts 27, 29 are manufactured of a flexible material and include tapered inner diameters. In these embodiments, the air outlets of the hair dryers, or other sources of heated air, are inserted into the heater mounts 27, 29, advanced to the point of contact with the tapered inside diameter, and pressed slightly further therein to expand the flexible material about the air outlets and hold them in place. In such embodiments, it is preferred that the heater mounts also include some means, such as straps, cables, set screws, or the like, for insuring that the sources or heated air are secured within the heater mounts and cannot inadvertently be dislodged during use.

The preferred embodiment of the cabinet 10 includes a right baffle 34 attached to the back wall 18 and right side wall 13 and a left baffle 36 attached to the back 18 and the left side wall 15. The baffles 34, 36 define both the drying compartment 20 and the air ducts 57, 59, and are preferably sealed such that heated air must flow into the air ducts 57, 59 before entering the drying compartment 20. The baffles 34, 36 may be manufactured of sheet metal and attached to the back wall 18 of the housing 12 using a tab and bolt arrangement of the type shown in FIG. 1. However, other embodiments may utilize molded plastic baffles, or a singe molded baffle insert to achieve similar results.

The preferred baffles 34, 36 include substantially straight portions 41, 43 are parallel with the right side wall 13 and left side wall 15, and bent portions 45,47, which extend inward and terminate proximate to the top wall 17 to form a top air opening 51 therebetween. As the air ducts 57, 59 formed by the straight portions 41, 43 of the baffles 34, 36 are preferably narrow, it is preferred that these straight portions 41,43 be disposed a distance of between 0.5 inches and 2.5 inches from, and in substantially parallel relation to, the right and left side walls 13, 15, respectively. However, it is recognized that air ducts 57, 59 may take a number of forms and should not be seen as being limited to the configuration described herein.

Each of the baffles 34, 36 preferably includes at least one, and ideally two, air openings 53, 55 therethrough. The air openings 53, 55 are preferably sized and disposed in locations that allow the heated air to be dispersed over the garment 26 to effect substantially uniform drying thereof In the preferred embodiment, the baffles 34, 36 are disposed and dimensioned such that no more than thirty percent (30%) of the air directed from the source of heated air into the interior of the housing 12 passes through the top air opening 51. This is accomplished by sizing the top air opening 51 to be six inches in width, disposing the straight portions 41,43 of the baffles 34, 36 one inch from the left and right side walls 13, 15, and providing right air openings 53 and the left air openings 55 each having a area of approximately seven square inches, and sizing the bent portions 45, 47 of the baffles such that air flow is diverted appropriately into the air ducts 57, 59. Although the above described arrangement is preferred, in other embodiments the baffles 34, 36 are disposed and dimensioned to produce different flow characteristics or, as described in detail below, may be eliminated altogether.

In some embodiments, the air openings 53, 55 through the baffles 34, 36 are merely holes that allow heated air to flow perpendularly from the baffles 34, 36. However, it is preferred that that air openings 53, 55 include air deflectors 61, 63 that are dimensioned to deflect the heated air both inward towards the drying compartment 20 and upward toward the top Wall 17 of the housing 12. In embodiments in which the baffles 34, 36 are manufactured of molded plastic, the deflectors 61, 63 are preferably molded into the baffles 34, 36 when the baffles 34, 36 are formed. However, in other embodiments, such as those in which the baffles are formed of sheet metal, the deflectors 61, 63 are formed separately and attached to the interior of the baffles 34, 36 during assembly.

The drying compartment 20 is dimensioned to accept the article of clothing 26. As shown in FIG. 1, the article of clothing 26 is a shirt. However, it is recognized that the housing may be adapted to dry and de-wrinkle other articles of clothing, or non-clothing items, such as towels, sheets, blankets, or the like. In the preferred embodiment of the invention, the drying compartment 20 of the housing 12 includes a hanging device 42, such as a hook or wire, positioned near the top wall 17 of the housing 12 and dimensioned to accept standard-sized coat hangers 44, upon which the article of clothing 26 is hung.

Figure 4:
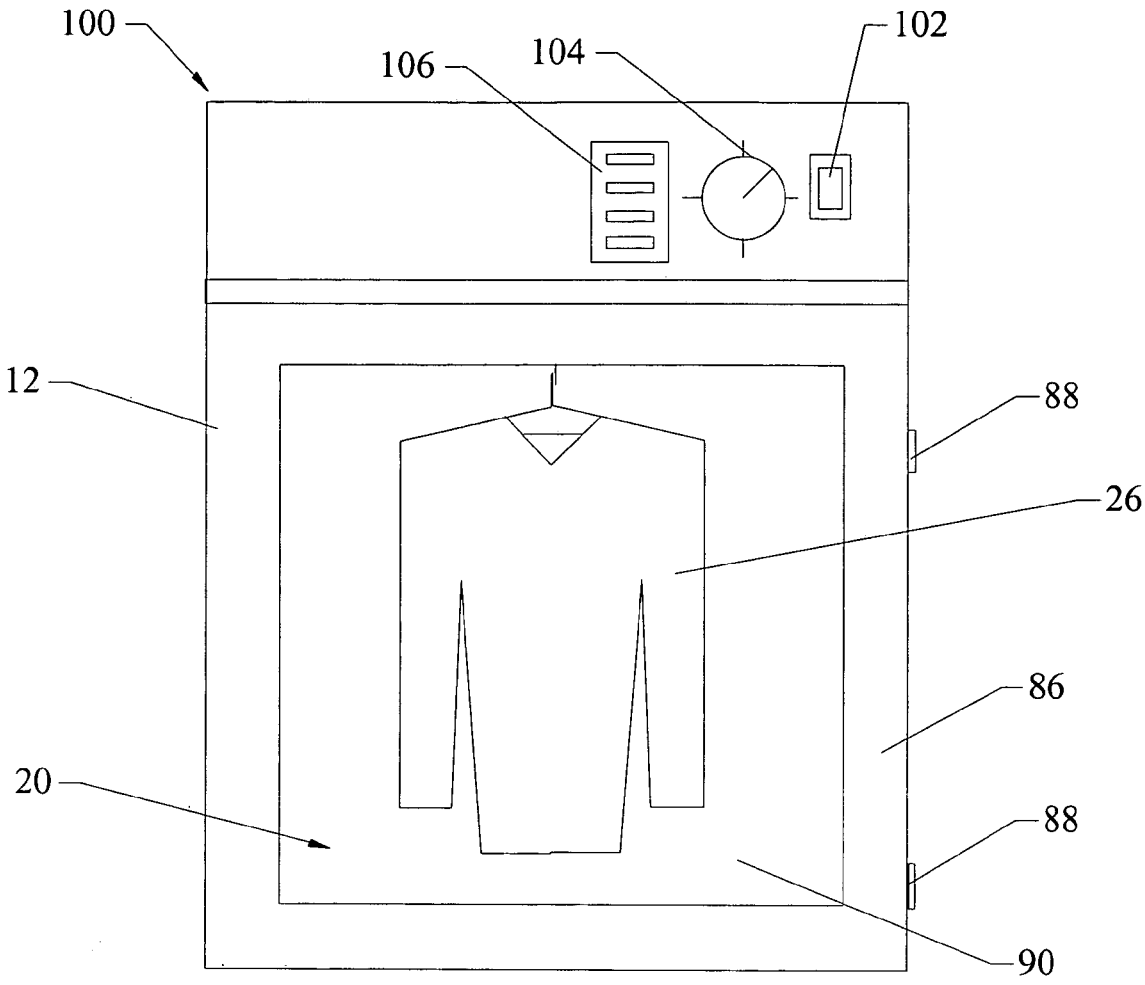
FIG. 4 is a front view of one embodiment of the garment dryer showing the control console and preferred door.

Finally, as shown in FIG. 4, a door 86 is preferably mounted on the front of the housing 12 and swings open on a hinge 88. However, in some embodiments, the door 86 is hingedly mounted on one side of the drying apparatus 10 and the clothing is inserted in through the side. In others, the door is mounted on the front of the housing and slides aside on rollers to expose the open front of the housing 12. The door is preferably dimensioned to seal the drying compartment 20 of the housing 12 such that so that a substantial portion of air does not escape therethrough. The preferred door 86 includes a transparent viewing panel 90 to allow a user to see the clothing disposed within the compartment. However, in others, the door is solid and provides no such viewing panel. Finally, in some embodiments, the door 86 is fitted with a contact (not shown) that allows a control system to determine whether or not the door is open or closed and to energize or de-energize the mechanical assembly based upon the open or closed position of the door.

Figure 2:
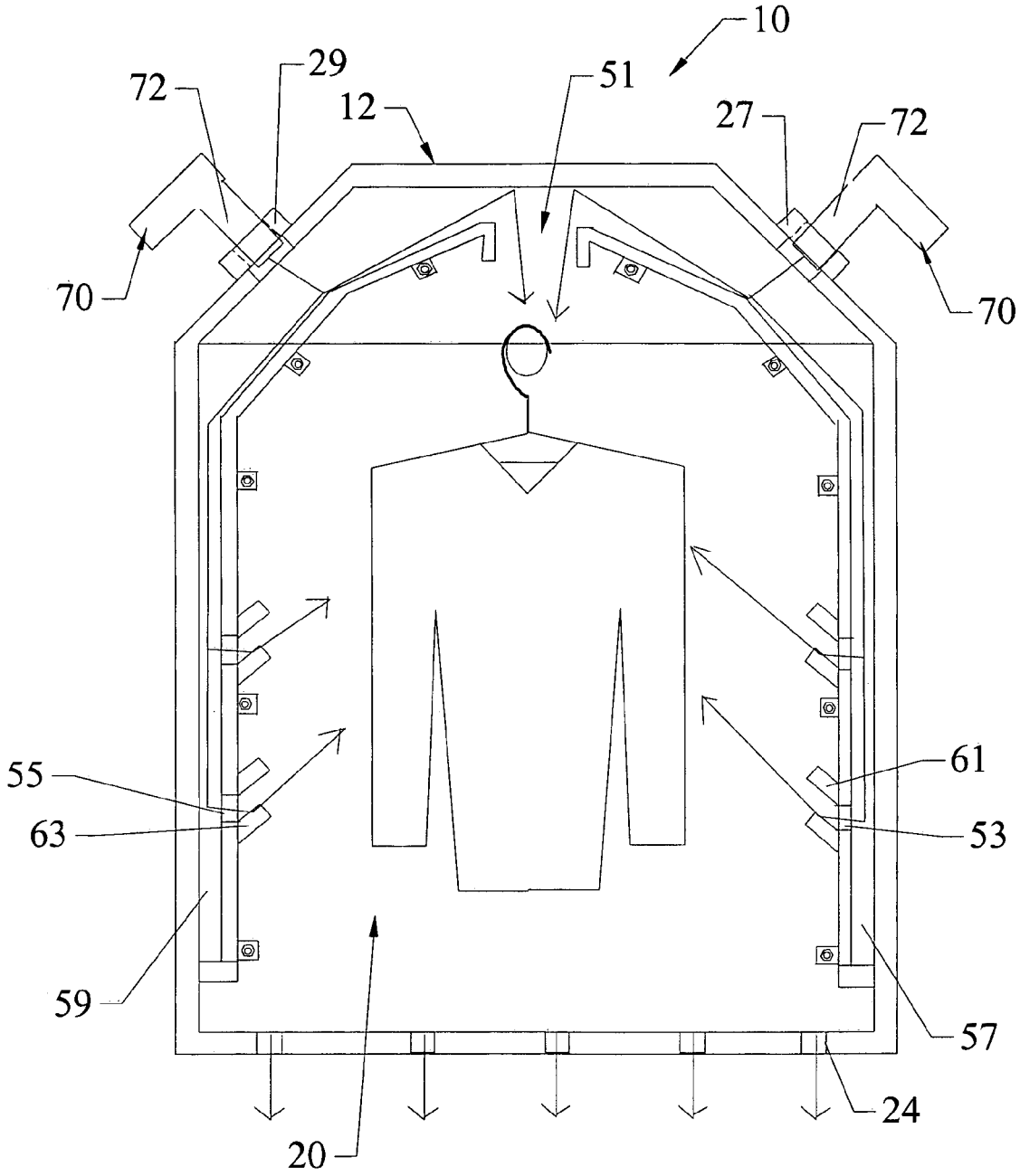
FIG. 2 is a diagrammatic view of the front of the preferred garment dryer of the present invention with a portion of the walls of the housing removed to show the flow patterns of air through the apparatus.

Referring now to FIG. 2, the movement of the air within the preferred drying cabinet is shown. First, heated air is directed through the air outlet 72 of each of the heaters 70 disposed within the heater mounts 27, 29 and impinges upon the bent portions 45, 47 of baffles 34, 36. A portion of the air is then diverted downward into air ducts 57, 59 and another portion of the air is directed upward toward the top wall 17. Because the baffles 34, 36 are substantially sealed, pressure builds up within the air ducts 57, 59 and in the area of the interior of the housing proximate to the top wall 12. Because the drying compartment 20 is vented to the exterior of the housing 12 via the air flowing through exhaust opening 24, the pressure within the drying compartment 20 is lower than that of the air ducts 57, 59 causing the heated air to flow downward through the top opening 51 and inward through the air openings 53, 55 through the baffles 34, 36. In the embodiment of FIGS. 1 and 2, the air drawn inward through the air openings 53, 55 through the baffles 34, 36 impinges upon deflectors 61, 63, which direct the air upward toward the top wall 17 and inward toward the garment 26. However, in embodiments in which deflectors 61, 63 are omitted, the air will flow substantially perpendicularly from the air openings 53, 55.

Figure 3A:
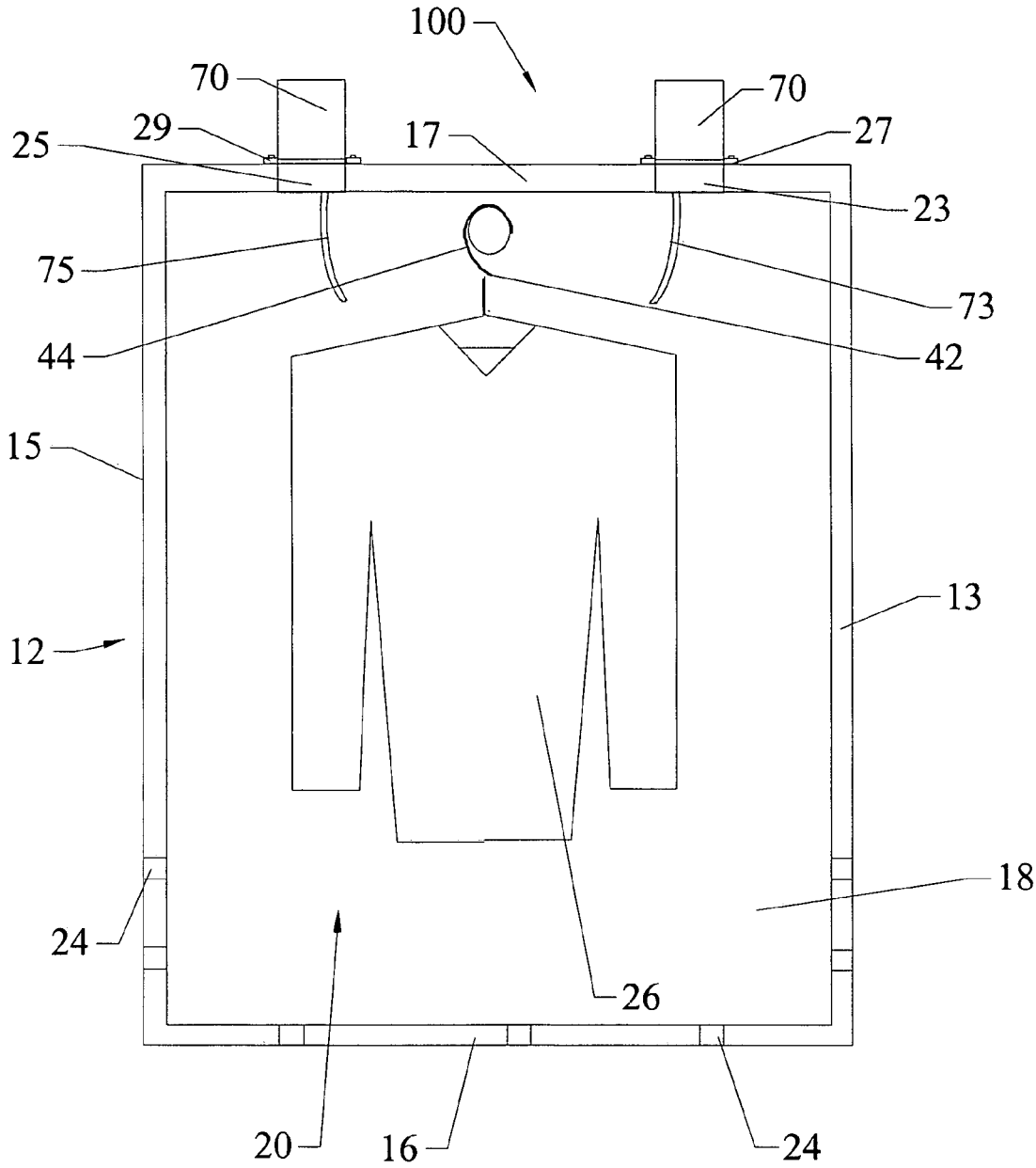
FIG. 3A is a cut away diagrammatic view of the front of an alternative garment drying cabinet of the present invention with a portion of the walls removed to show air deflectors an their relationship to the heater openings.
Figure 3B:
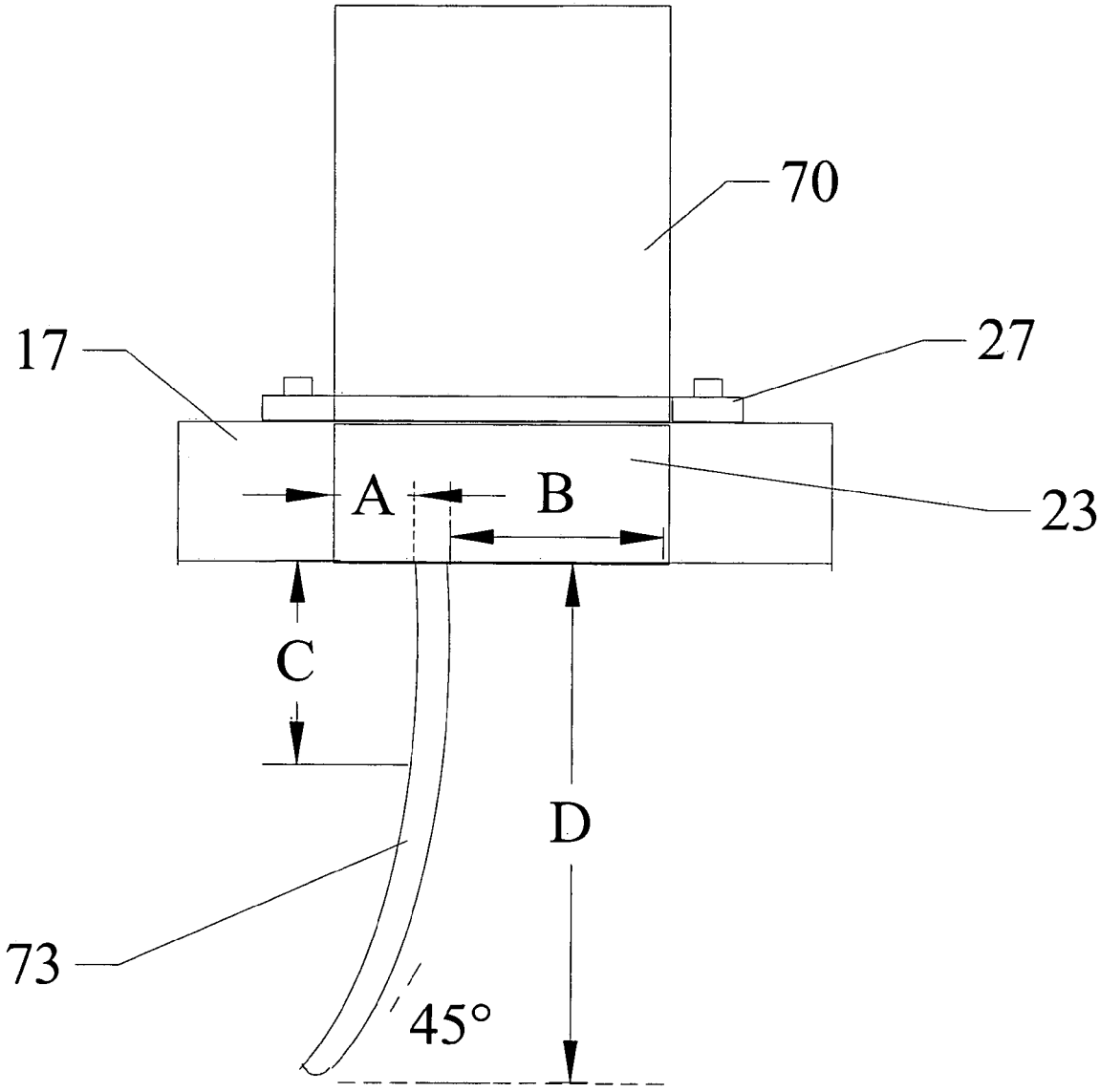
FIG. 3B is an exploded view of the right heater and deflector of the garment dryer of FIG. 3A showing the preferred dimensions and location of the deflector.

Referring now to FIGS. 3A and 3B, an alternative embodiment of the garment dryer 100 is shown. In this embodiment, the housing 12 of the garment drying cabinet 10 is a rectangular cubiod that does not include the angled walls 19, 21 of the embodiments of the housing 12 shown in FIGS. 1 and 2. Rather, the right side wall 13 and left side wall 15 are attached in substantially perpendicular relation to the top wall 16, and the heater openings 23, 25 are disposed through the top wall. Further, in this embodiment, baffles 34, 36 are eliminated and are replaced by air deflectors 73, 75 mounted proximate to the heaters 70.

The air deflectors 73, 75 of FIGS. 3A and 3B are preferably curved pieces of metal that are mounted in the path of the air flowing from the heaters 70 to the heater openings and deflects a portion of the heated air toward the center of the hanging garment 26 while allowing the remainder of the air to flow in a substantially straight fashion over the periphery of the garment. As shown in detail in FIG. 3B, the preferred deflector 73 is mounted a distance A from the edge of the heater opening 23 such that approximately ten percent of the air flowing from the heater 70 will flow through this area and be directed toward the center of the garment and such that that the remaining ninety percent will flow straight through area B over the periphery of the garment. The preferred deflectors 73, 75 extend a distance D into the cabinet, preferably approximately six and three eights inches long, and include a straight portion C, which is preferably approximately three and one half inches, and a curved portion that terminates at an approximately forty five degree angle from a line extending perpendicular to the straight portion. The preferred deflectors 73, 75 terminate approximately two inches from the top of the garment 26 so as to create significant turbulence when the heated air comes into contact therewith. However, it is recognized that the air deflectors 73, 75 may take a number of forms and should not be seen as being limited to the preferred embodiment described herein.

The heaters 70 of this embodiment are not hair dryers, but rather are specialized heaters designed specifically for this application. As was the case with the embodiments above, the heaters 70 are attached to the housing 12 via heater mounts 27, 29. However, the heater mounts 27, 29 of this embodiment need not account for variations in the size of the heaters 70 and, therefore, may simply be traditional bracket and bolt type mounts. The heaters 70 preferably include cylindrical housing within which are mounted a ceramic heater and a centrifugal fan. The preferred heaters each have a diameter of between 1.5 inches and 3.5 inches and each preferably produces a volume of airflow of between 40 and 70 cubic feet per minute. These are preferred as it was found that lower volumes of air blown at higher velocity over the garment 26 allowed the temperature within the housing 12 to remain above 130 degrees Fahrenheit while providing greater evaporative capacity than could be achieved using fans blowing larger volumes of air into the housing 12 at lower velocity. However, it is recognized that other types of heaters 70 may be utilized and that the garment dryer 100 is not limited to the preferred heaters 70 described herein.

Referring now to FIG. 4, the front of one embodiment of an assembled drying apparatus 10 is shown. In this embodiment, user controls, 102, 104, 106 are mounted to a panel 80 on the front of the upper compartment 22 of the housing 12 for easy access by the user. However, in other embodiments, the user controls 102, 104, 106 may be mounted to the side of the upper compartment 22, or may be located directly upon the heaters themselves.

The user controls 102, 104, 106 of the embodiment of FIG. 4 are an on/off switch 102, a timer switch 104, and a cycle selector 106. The on/off switch 102 controls the operation of dryer 100. The timer switch 104 energizes and de-energizes the heater (not shown) based upon its rotational position. As shown in FIG. 4, the timer switch 104 is a common analog switch, operating in a manner similar to a timed sauna or whirlpool control. However, other art recognized timing devices, such as digital clocks, timing circuits, or the like, may be substituted to achieve similar results. The cycle selector 106 in the embodiment of FIG. 4 is a series of buttons that allows a user to choose the type of clothing to be dried. As the selector 106 of FIG. 4 does not need to perform any timing or humidity control functions, this selector is essentially a temperature control, which sets the desired temperature between ambient and two hundred degrees Fahrenheit depending upon the type of clothing to be dried. However, in other embodiments, the cycle selector 106 sets the desired temperature and time for drying. In others, the cycle selector 106 sets temperature, time and humidity set point based upon the clothing to be dried. In still others, the cycle selector 106 sets the time for drying based upon the type and/or number of articles of clothing to be dried.

The garment dryer 100 of the present invention is readily adapted for use in a number of different applications. For example, the apparatus may be used as an air freshener by opening the door and placing a typical automotive air freshener on the hanging device. Similarly, the apparatus are readily adapted for use in home dry cleaning, by hanging the cleaning bag on the hanger. In such uses, the dry cleaned clothing need not be ironed as they emerge wrinkle free from the apparatus.

Although the present invention has been described in considerable detail with reference to certain preferred versions thereof, other versions or applications would be readily apparent to those of ordinary skill in the art. Therefore, the spirit and scope of the appended claims should not be limited to the description of the preferred versions contained herein.

What is claimed is:

1. A garment drying cabinet for use in combination with a source of heated air to form a garment dryer, wherein said garment drying cabinet comprises:

a housing comprising a back wall, a right side wall, a left side wall, a top wall, a bottom wall, a right angled wall attached to said back wall, said top wall and said right wall, and a left angled wall attached to said back wall, said top wall and said left wall, wherein said walls define an interior and an exterior of said housing, wherein at least one heater mounting opening is disposed through said housing, and wherein at least one exhaust hole is disposed through at least one of said bottom wall, said right side wall, and said left side wall of said housing;

a right heater mount attached to and disposed through said right angled wall of said housing and a left heater mount attached to and disposed through said left angled wall of said housing, wherein right heater mount and said left heater mount are dimensioned to attach the source of heated air to the exterior of the housing such that substantially all of the air directed from the source of heated air is delivered into said interior of said housing;

at least one air diverter mounted in a path of the air directed from the source of heated air; and a cabinet door movably attached to said housing.

2. The garment drying cabinet as claimed in claim 1 wherein said at least one air diverter comprises a pair of deflectors.

3. The garment drying cabinet as claimed in claim 2 wherein said at least one air deflector comprises two deflectors and wherein each of said deflectors is attached to said housing in a location so as to direct approximately ten percent of the air directed from the source of heated air toward a center of the garment and to allow the remaining ninety percent of the air directed from the source of heated air to flow over the periphery of the garment.

4. The garment drying cabinet as claimed in claim 1 wherein said at least one air diverter comprises a pair of deflectors.

5. The garment drying cabinet as claimed in claim 4 wherein said at least one air deflectors comprises two deflectors and wherein each of said deflectors is attached to said housing in a location so as to direct approximately ten percent of the air directed from the source of heated air toward a center of the garment and to allow the remaining ninety percent of the air directed from the source of heated air to flow over the periphery of the garment.

6. A garment dryer comprising:

a garment drying cabinet comprising:

a housing comprising a back wall, a right side wall, a left side wall, a top wall and a bottom wall defining an interior and an exterior of said housing, wherein at least one heater mounting opening is disposed through said housing, and wherein at least one exhaust hole is disposed through at least one of said bottom wall, said right side wall, and said left side wall of said housing;

at least one heater mount attached to said housing, wherein said at least one heater mount is dimensioned to attach the source of heated air to the exterior of the housing such that substantially all of the air directed from the source of heated air is delivered into said interior of said housing;

at least one air diverter mounted in a path of heated air from the source of heated air; and a cabinet door movably attached to said housing; and at least one heater attached to said at least one heater mount wherein said housing of said garment drying cabinet further comprises a right angled wall attached to said back wall, said top wall and said right wall, and a left angled wall attached to said back wall, said top wall and said left wall;

wherein said at least one heater mount comprises a right heated mount disposed through said right angled wall and a left heated mount disposed through said left angled wall; and wherein said at least one heater comprises a right heater attached to said right heater mount and a left heater attached to said left heater mount.

7. The garment dryer as claimed in claim 6 wherein each of said right heater and said left heater has a diameter of between 1.5 inches and 3.5 inches and wherein each of said right heater and said left heater produces a volume of airflow of between 40 and 70 cubic feet per feet.

8. The garment dryer as claimed in claim 6 wherein said right heater, said left heater, and said cabinet are dimensioned and adapted to maintain a temperature of at least 130 degrees Fahrenheit within said interior of said housing.

9. The garment dryer as claimed in claim 6 wherein said at least one air diverter comprises at least one baffle attached to interior of said housing;

wherein said at least one baffle is attached to said housing a predetermined distance from at least one of said right side wall, said left side wall, and said top wall of said housing so as to define at least one air duct and at least one drying compartment;

wherein said at least one baffle comprises at least one air opening disposed therethrough such that said at least one air duct is in fluid communication with said at least one drying compartment; and wherein said at least one air duct is sealed such that a substantial portion of the heated air delivered into said interior of said housing from said source of heated air will flow through said at least one air opening into said at least one drying compartment.

10. The garment dryer as claimed in claim 9 herein said at least one baffle comprises a right baffle and a left baffle, wherein said right baffle is attached to said back wall and said right side wall of said housing and said left baffle is attached to said back wall and said left side wall of said housing, and wherein said right baffle and said left baffle are dimensioned and disposed such that a top air opening is formed therebetween.

11. The garment dryer as claimed in claim 6 herein said at least one air diverter comprises a pair of deflectors and wherein each of said deflectors is attached to said housing in a location so as to direct approximately ten percent of the air directed from the source of heated air toward a center of the garment and to allow the remaining ninety percent of the air directed from the source of heated air to flow over the periphery of the garment.

12. A garment drying cabinet for use in combination with a source of heated air to form a garment dryer, wherein said garment drying cabinet comprises:

a housing comprising a back wall, a right side wall, a left side wall, a top wall and a bottom wall defining an interior and an exterior of said housing, wherein at least one heater mounting opening is disposed through said housing, and wherein at least one exhaust hole is disposed through at least one of said bottom wall, said right side wall, and said left side wall of said housing;

at least one heater mount attached to said housing, wherein said at least one heater mount is dimensioned to attach the source of heated air to the exterior of the housing such that substantially all of the air directed from the source of heated air is delivered into said interior of said housing;

at least one air diverter mounted in a path of the air directed from the source of heated air; and a cabinet door movably attached to said housing;

wherein said at least one air diverter comprises a right baffle and a left baffle;

wherein said right baffle is attached to said back wall and said right side wall of said housing and said left baffle is attached to said back wall and said left side wall of said housing so as to define two air ducts and a drying compartment;

wherein at least one of said right baffle and said left baffle comprises at least one air opening disposed therethrough such that at least one of said two air ducts is in fluid communication with said at least one drying compartment;

wherein said right baffle and said left baffle are dimensioned and disposed such that a top air opening is formed therebetween; and wherein said air ducts are sealed such that a substantial portion of the heated air delivered into said interior of said housing from said source of heated air will flow through said air openings in said right baffle and said left baffle and through said top air opening into said drying compartment.

13. The garment drying cabinet as claimed in claim 12 wherein said at least one air opening comprises at least one right air opening disposed through said right baffle and at lest one left air opening disposed through said left baffle, and wherein said top air opening, said right air opening and said left air opening are each disposed within said housing and dimensioned such that no more than thirty percent of the air directed from the source of heated air into said interior of said housing passes through said top air opening.

14. The garment drying cabinet as claimed in claim 12 wherein a substantial portion of said right baffle is disposed a distance of between 0.5 inches and 2.5 inches from, and in substantially parallel relation to, said right side wall; and wherein a substantial portion of said left baffle is disposed a distance of between 0.5 inches and 2.5 inches from, and in substantially parallel relation to, said left side wall.

15. The garment drying cabinet as claimed in claim 12 wherein said at least one right air opening comprises two right air openings and wherein said at least one left air opening comprises two left air openings.

16. The garment drying cabinet as claimed in claim 15 wherein at least one of said right air openings and said left air openings comprises an air deflector dimensioned to deflect the heated air both inward towards said drying compartment and upward toward said top wall of said housing.

17. The garment drying cabinet as claimed in claim 12:

further comprising a right angled wall attached to said back wall, said top wall and said right wall, and a left angled wall attached to said back wall, said top wall and said left wall;

wherein said at least one heater mount comprises a right heater mount disposed through said right angled wall and a left heater mount disposed through said left angled wall.

* * * * *